US007028405B2

(12) United States Patent
Paas et al.

(10) Patent No.: US 7,028,405 B2
(45) Date of Patent: Apr. 18, 2006

(54) VIBRATORY SHAVER

(75) Inventors: Edward L. Paas, Los Altos, CA (US); Richard C. Stange, Oceanside, CA (US); H. Fisk Johnson, III, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 142 days.

(21) Appl. No.: 10/379,817

(22) Filed: Mar. 4, 2003

(65) Prior Publication Data

US 2004/0172831 A1 Sep. 9, 2004

(51) Int. Cl.
*B26B 19/28* (2006.01)

(52) U.S. Cl. ..... 30/45; 30/44

(58) Field of Classification Search ..... 30/541, 30/535, 536, 44, 45, 527, 42, 534, 526
See application file for complete search history.

(56) References Cited

U.S. PATENT DOCUMENTS

| | | | | |
|---|---|---|---|---|
| 2,511,188 | A * | 6/1950 | Whipple | 30/36 |
| D169,147 | S * | 3/1953 | Lamb | D28/48 |
| 3,611,568 | A | 10/1971 | Alexander et al. | |
| 3,636,627 | A | 1/1972 | Tiffin | |
| 3,648,368 | A | 3/1972 | Douglass et al. | |
| 3,772,779 | A | 11/1973 | Douglass et al. | |
| D290,532 | S | 6/1987 | George | |
| 4,744,144 | A * | 5/1988 | Lowery et al. | 30/45 |
| 4,819,330 | A | 4/1989 | Fenn et al. | |
| 4,908,945 | A * | 3/1990 | Jacobson | 30/41 |
| 4,914,816 | A * | 4/1990 | Fenn et al. | 30/45 |
| 4,918,818 | A * | 4/1990 | Hsieh | 30/34.05 |
| 5,007,169 | A | 4/1991 | Motta | |
| 5,046,249 | A * | 9/1991 | Kawara et al. | 30/45 |
| 5,214,851 | A * | 6/1993 | Althaus | 30/45 |
| 5,261,430 | A * | 11/1993 | Mochel | 132/322 |
| 5,299,354 | A * | 4/1994 | Metcalf et al. | 30/45 |
| 5,544,415 | A * | 8/1996 | Huang | 30/43.92 |
| 5,678,316 | A * | 10/1997 | Althaus et al. | 30/527 |
| 5,771,591 | A * | 6/1998 | Armbruster et al. | 30/527 |

(Continued)

FOREIGN PATENT DOCUMENTS

| | | |
|---|---|---|
| EP | 0266080 | 5/1988 |

(Continued)

OTHER PUBLICATIONS

A 2002 advertisement for the "Bump Fighter" razor, admitted prior art. Cited to show the concept of a replaceable razor cartridge mounted by sliding on a mounting handle.

(Continued)

*Primary Examiner*—Allan N. Shoap
*Assistant Examiner*—Ghassem Alie

(57) ABSTRACT

Vibratory shavers are provided having a battery powered DC motor, which when energized rotates a weight eccentrically mounted to a motor shaft. The rotating weight imparts vibratory motion in the shaver housing and thereby a razor cartridge attached to the head of the shaver. The housing is specially designed so that the shaver head will move more front to back than side to side. This can be achieved (a) with the shaver housing having a wider aspect than a front to back aspect; (b) by thickening the side walls of the neck of the shaver relative to the front and back walls of the neck; and (c) by appropriately positioning and designing braces of varied thicknesses. The housing of the shaver may be permanently sealed and provided with a battery that may be recharged via induction. Alternatively, a cap can be provided to provide access to a replaceable battery.

20 Claims, 8 Drawing Sheets

U.S. PATENT DOCUMENTS

| | | | | |
|---|---|---|---|---|
| 6,105,252 | A * | 8/2000 | Andis | 30/45 |
| 6,421,918 | B1 * | 7/2002 | Dato et al. | 30/45 |
| 6,481,104 | B1 | 11/2002 | Parker et al. | |

FOREIGN PATENT DOCUMENTS

| | | |
|---|---|---|
| FR | 2611570 | 9/1988 |

OTHER PUBLICATIONS

A 2001 use and care manual by Sonex entitled "Dual Frequency Ultrasonic Toothbrush". The cited art relates to a prior art toothbrush having a charging stand, induction system and drive similar to that of the present invention, albeit to drive a toothbrush.

* cited by examiner

VIBRATORY SHAVER

CROSS-REFERENCE TO RELATED APPLICATIONS

Not applicable.

STATEMENT OF FEDERALLY SPONSORED RESEARCH OR DEVELOPMENT

Not applicable.

BACKGROUND OF THE INVENTION

This invention relates to shaving implements and in particular to electric shavers.

There are numerous types of electric and manual implements on the market today for removing or trimming hair present on various skin areas, especially hair on faces of men and on legs of women. Conventional manual razors have a handle with one or more straight razor blades at an upper end. Often these razors are designed to be entirely disposed of after a period of use, or the blade section of the razor is intended for disposal and replacement (with the handle being used more permanently). Such manually moved razors are suitable to be used when the skin is wet, and often when the skin is treated with a shaving cream, soap or lotion. However, the effectiveness of such shavers is limited by the ability of a human hand to manipulate the shaver head.

Well-known conventional electric shavers have rotating or reciprocating blades disposed beneath a perforated screen through which the individual hairs must pass to be cut during shaving. The need for the protective screen can lead to a less consistent and "close" shave, unless various complex and costly techniques are employed to correct this problem. In any case, such electric razors are ordinarily unsuitable for use with conventional shaving creams, and many are not designed for use in a wet environment such as a shower. This latter restriction is of particular concern as many women prefer to shave their legs during their shower.

There also exist some types of hybrid shavers which combine some benefits of manual razors and some of electric shavers. Specifically, these hybrid shavers can be used with shaving cream in a wet environment, while also using electric power to more rapidly move the shaving blade.

Examples of such shavers include U.S. Pat. Nos. 4,744,144, 4,819,330, 4,914,816, 5,046,249 and 5,299,354. The disclosures in these patents, as well as all that in other patents cited herein, are hereby incorporated by reference as through fully set forth herein.

Some of these disclose a shaver having a handle or body containing an electric oscillator or vibration inducing component and to which is attached a straight bladed razor cartridge. Others disclose vibrating shavers having switch-operated and battery-powered DC motors.

In some hybrid shavers, e.g. U.S. Pat. No. 5,007,169, the shaver directly couples a stem of a shaver head to the motor shaft. Others, e.g. U.S. Pat. Nos. 3,611,568; 5,046,249 and 6,105,252, impart oscillatory motion to the razor head without direct coupling to the motive means. This can be done, for example as disclosed in U.S. Pat. Nos. 5,299,354 and 6,105,252, by eccentrically mounting a weight to the rotatable motor shaft.

Rotation of the shaft causes off-center rotation of the weight which in turn imparts oscillatory motion to the razor blade(s). This motion can be passed through a unitary neck extending between the main body of the housing and the razor head, as disclosed in U.S. Pat. Nos. 3,636,627; 5,299,354 and 6,481,104. As disclosed in U.S. Pat. No. 6,421,918, the motion can even be in the ultrasonic range.

These hybrid shavers typically employ an oscillating pattern for their shaving heads. Some, like those in U.S. Pat. No. 3,636,627, use an essentially circular pattern, while others essentially sweep side to side. Significant side to side motion tends to increase the risk of cuts, particularly when the tolerances of manufacture are not precise.

U.S. Pat. No. 6,481,104 discloses a primarily front to back (towards and away from the skin) motion by locating the vibration axis of the weight parallel to the razor blades. However, the means of achieving this motion is costly. Further, the vibration rates of the '104 patent impart an uncomfortable feel to the user's hand.

The art therefore still desires improved assemblies for shaving human skin, where the shaving is effective, and can be achieved in a wet environment using conventional shaving creams and gels.

SUMMARY OF THE INVENTION

The invention provides a vibratory shaver. There is an outer housing having an elongated body defining front, back and opposite side walls, a neck extending essentially axially from the body, and a head attached to the neck at a location remote from the body. The body and neck (and preferably the body, neck, and head) are formed, at least in part, from a continuous surface to resist side to side motion more than front to back motion. Alternatively expressed, the body and neck are formed as an essentially continuous, non-jointed structure resisting side to side motion to a greater degree than front to back motion, where "non-jointed" refers not to seams or other features where parts are substantially rigidly joined together, even if the parts still can bend or flex, but, instead, to joints intended to allow parts to pivot or otherwise move relative to each other.

The neck (and preferably the body and neck in combination) is so formed as to resist side to side (lateral) motion to a greater degree than it resists front to back motion. As will be discussed further below, the neck can be solid (at least partially) or hollow and formed in any of several ways to achieve the preferred motion. For example, the neck can be formed with a maximum lateral dimension which is greater than its maximum front to back dimension, and preferably with its lateral dimension being greater than its front to back dimension over its entire length, causing it to be preferentially laterally stiff, compared to its front to back stiffness. Alternatively or in combination with that dimensional feature, the neck can be forwardly arched or curved, somewhat like the curve of a cupped hand. Preferably, the neck curves forwardly from the back-most surface of the body or even curves first backwardly from the body and then forwardly. This shape encourages preferentially lateral stiffness. Also alternatively, if the neck is hollow, the relative thickness of the side versus the front and back walls can be adjusted to affect relative flexibility, preferably with the side walls being thick compared to the front and back walls. If the neck is hollow, internal bracing also can be adjusted to resist lateral flexing while offering lesser resistance to front to back flexing.

A battery is positioned in the body. A motor capable of being energized by the battery is also positioned in the body. Further, a weight is positioned in the housing and mounted to the motor so as to be rotated thereby to vibrate the housing. With the neck (or the combined body and neck)

formed as disclosed above, rotation of the weight can cause the head of the shaver to oscillate with a greater front to back amplitude than lateral amplitude. It has been determined that plastic materials provide desirable vibratory characteristics, while also being resistant to water damage. Of course, other materials may also prove suitable.

In one form there is a removable lower cap suitable for facilitating access to the battery. This is a form most suited for situations where the battery is disposable and replaceable after being used. This might be most appropriate for a men's shaver designed for use at a bathroom lavatory.

In another form the shaver can be made rechargeable and have a permanently sealed housing. In such a case there can be a recharging cradle having a receiving cavity suitable for receiving a lower end of the housing. The cradle can be capable of recharging the battery via induction.

In any case, it is intended that the shaver be used with a razor cartridge having a blade and the head include an attachment feature for removably connecting the razor cartridge to the head. For example, the attachment feature can be a side to side rail and the razor cartridge can be formed with a slot for receiving the rail. The parts can interlock in known ways on a temporary basis.

In other preferred aspects there can be a switch for controlling operation of the motor, the switch being controllable from outside the housing, and the motor can have a shaft extending axially with respect to the handle, with the weight being mounted to the motor shaft eccentrically.

To minimize hand discomfort, while retaining the benefits of the vibration, we have found an optimal oscillation range of 100 to 200 cycles per second, preferably an oscillation of less than 150 cycles per second, even more preferably an oscillation rate of between 120 and 140 cycles per second. With respect to oscillation amplitude, we prefer the lateral movement of the head to be less than 0.02 cm.

As already discussed, the desired vibratory pattern can be achieved in various ways. For example, one form of the invention is a vibratory shaver having a solid (at least in part) but somewhat neck flexing more from front to back than side to side. In another version, the neck is hollow and defines a front neck wall, a back neck wall, and lateral neck walls connecting the front and back neck walls. The front neck wall (and preferably also the back neck wall) has at least a part of it which has a lesser thickness than at least a part of a lateral neck wall (and preferably of both lateral neck walls). In another form the vibratory pattern is achieved because bracing positioned in the housing favors front to back over lateral flexing. This can be achieved, for example, by providing a longitudinal rib attached to or unitarily formed with one or both lateral neck walls, either projecting inwardly or outwardly, the rib extending longitudinally for a part and preferably for the majority of the length of the neck. Forming the neck and/or neck and body so as to be laterally wider than it is deeper from front to back has already been discussed, as has forming the neck with a forward curve. In any event, the essence of the invention is that a stiffening means is provided to cause the head of the shaver to move preferentially in the desired, forward and backward pattern, without the need for pivoting or other jointed connections between or within the body, neck, or head.

Because the shaver is designed for use with, and may include, a disposable razor cartridge, once a blade becomes dull it can easily be replaced. Further, the blades may be of conventional design, thus providing the shaver with all the benefits of a conventional hand operated shaver. Further, because the housing can be made watertight, the shaver can be designed for use in a shower or other wet environment. Nevertheless, the desired benefits of electrical movement of the shaver head are made available without unacceptable risk of side to side cuts.

It should be appreciated that the precise configuration of the attachment feature and the razor cartridges is not critical to the performance of the invention. Thus, the razor cartridge could clip or snap onto the shaver in any suitable fixed or pivoting connection.

The present invention thus provides a relatively low-cost electric shaver capable of using conventional disposable razor cartridges for wet or dry shaving. A low cost and reliable oscillator vibrates the housing to impart a short, rapid oscillatory motion to the razor cartridge. The dimensional and/or other physical attributes of the housing tend to limit the side to side movement of the razor cartridge such that the net motion is greater from front to back without the need for moving pivots or joints at any point along the length of the housing. Such motion improves the hair cutting efficiency per stroke of the shaver, thereby providing a closer shave in less time.

These and other advantages of the invention will be apparent from the detailed description and drawings. It should be understood that the following are merely preferred embodiments of the invention. The claims should be looked to in order to understand the full scope of the invention.

BRIEF DESCRIPTION OF THE DRAWINGS

FIG. 2 is a partial front view of the shaver's neck and head, and a replaceable razor cartridge separated there from;

DETAILED DESCRIPTION OF THE PREFERRED EMBODIMENTS

A vibratory shaver of the present invention will now be explained by describing in detail two preferred embodiments, namely, a rechargeable battery powered shaver shown in FIGS. 1–6 and a non-rechargeable battery powered shaver shown in FIGS. 7–8. Both embodiments provide essentially the same oscillatory motion, use replaceable razor cartridges, and are identical except for the power source and housing configuration (and as otherwise noted).

Figure 2:
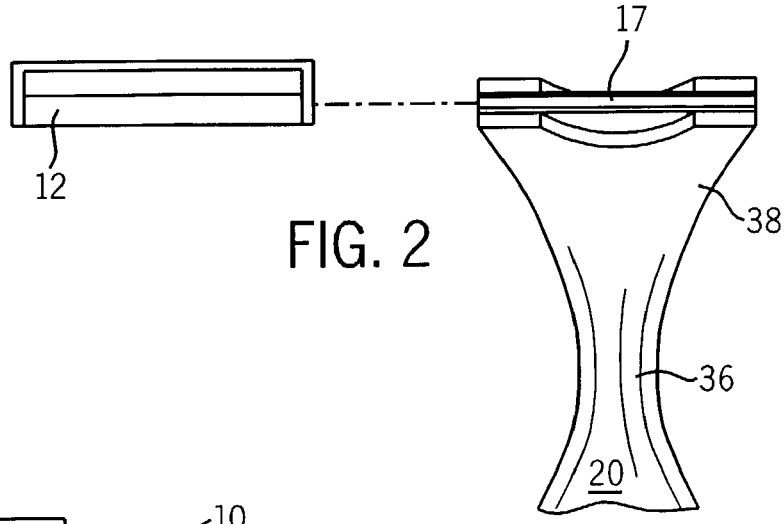
Figure 1:
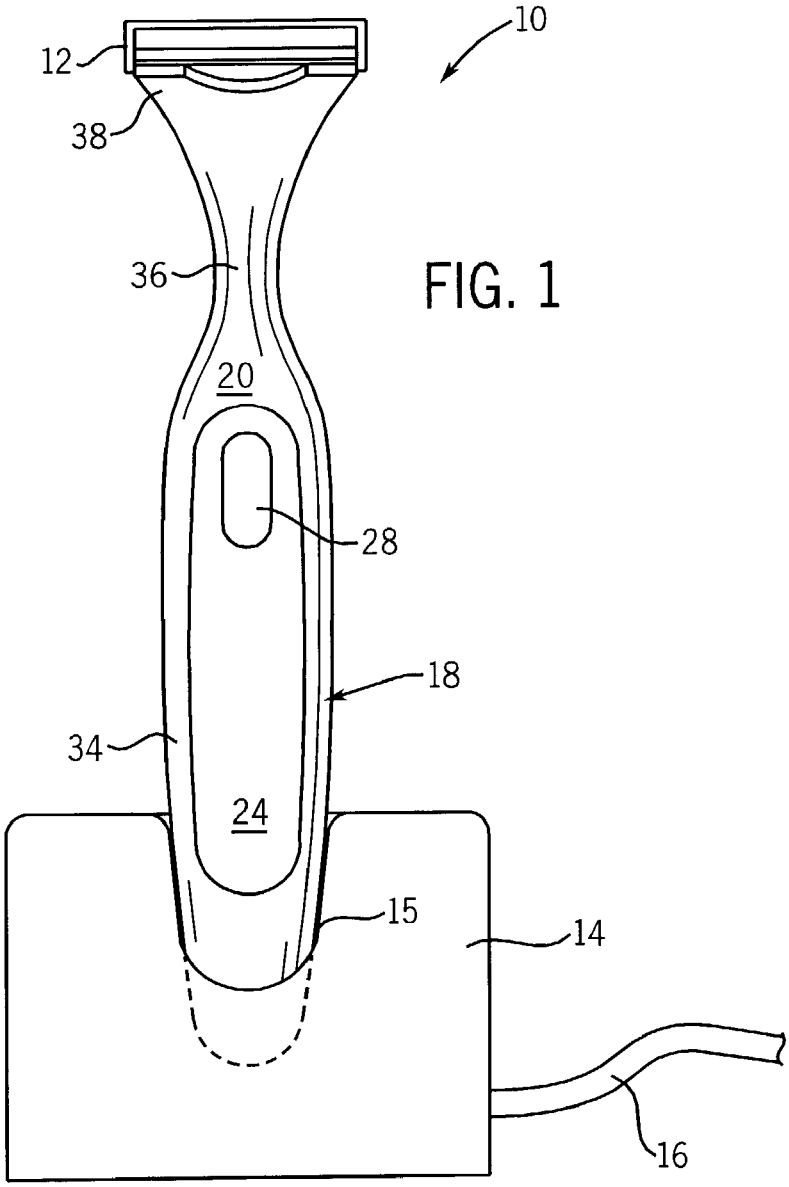
FIG. 1 is front plan view of a first, rechargeable embodiment of a vibratory shaver of the present invention, shown resting in a recharging cradle.
Figure 3:
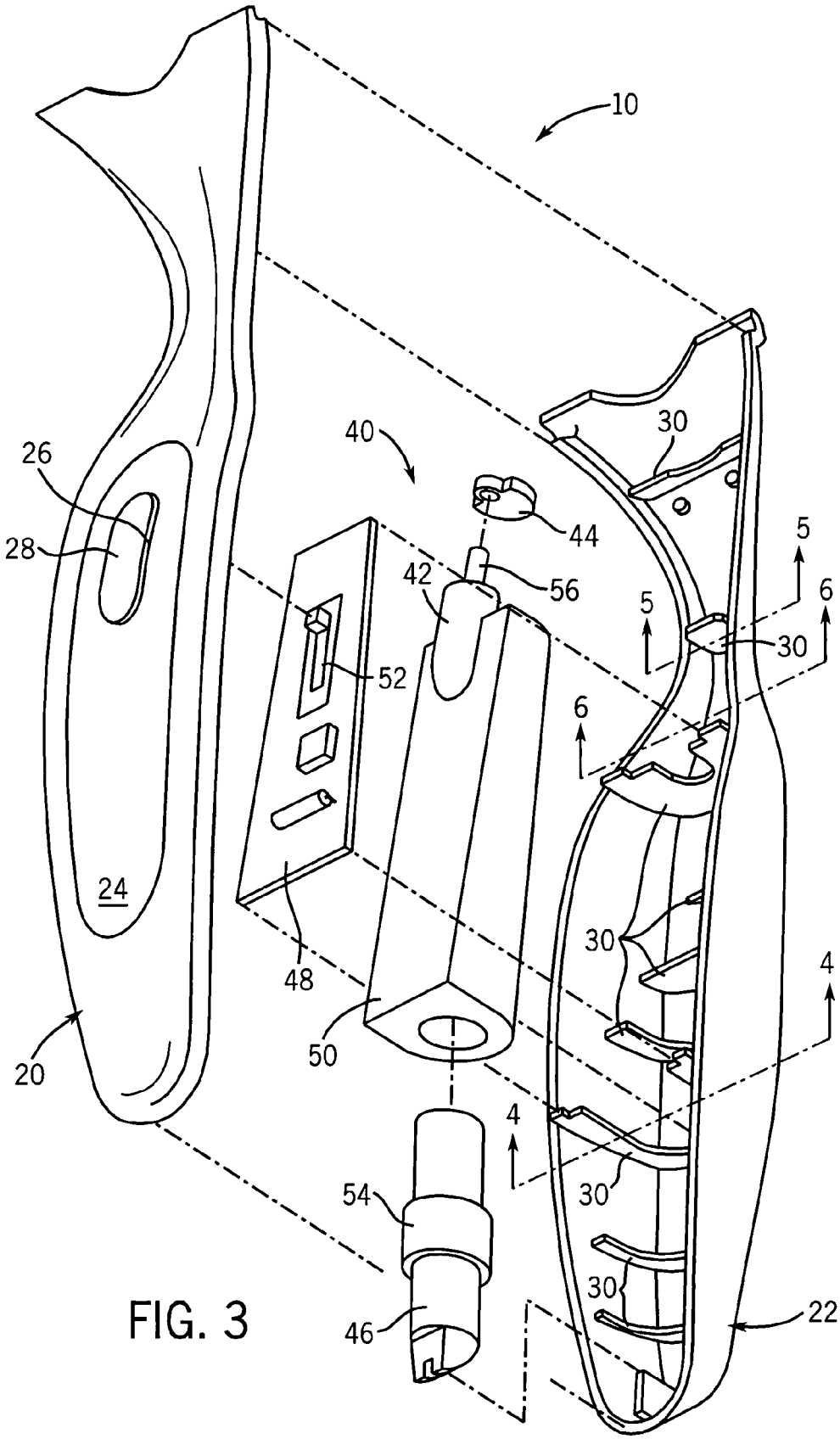
FIG. 3 is an exploded view of the shaver, shown without a razor cartridge.

Referring first to FIGS. 1–3, a shaver 10 having a razor cartridge 12 rests in an upright position in a recharging cradle 14 when not in use. The cradle 14 defines a recess 15 and includes a power cord 16 which plugs into a conventional power outlet (not shown). The power cord 16 is connected to a coil (not shown) in the cradle interior for inductively charging the shaver 10, as known in the art and described in more detail below.

The razor cartridge 12 can be any straight razor blade. However, it is preferably a conventional disposable razor cartridge. The razor cartridge 12 can be mounted permanently to the shaver 10, but is preferably removable so that it can be easily replaced when dull. The razor cartridge 12 can be mounted using any pivotal or non-pivotal connection. However, a non-pivotal connection is preferred. Thus, the razor cartridge 12 can have a back side channel (not shown) which can slide onto a straight rail 17 (preferably mounted onto or molded into the exterior of the shaver 10) to mount the razor cartridge 12 (see FIGS. 1 and 2).

With reference to FIG. 3, the shaver 10 has a housing 18, preferably injection molded from a suitable grade acrylonitrile-butadiene-styrene ("ABS") plastic, defined by a front cover 20 and a back part 22. The front cover 22 has a tactile over molded section 24 for better grip and an opening 26 for a switch button 28 to extend. The cover 20 and back part 22 are each formed with aligned unitary ribs 29 and 30 spaced apart and extending into an interior cavity 32 formed when the two parts are joined.

When the front cover 20 is joined with the back part 22, optionally by ultrasonic welding along the seam between the two parts, the housing 18 forms a hollow ergonomically contoured piece defining a handle or main body section 34, a narrowed/neck section 36 and a broad head section 38. As shown in FIGS. 3–6, preferably at every location along the length (or longitudinal dimension) of the shaver 10, and at least along the neck section 36, the housing 18 is wider (or has a greater lateral or side to side dimension) than it is deep (or in the front to back dimension).

Within the body section 34 of the housing interior cavity 32 resides an electrical oscillator 40, including a DC motor 42, an off-center weight 44, a rechargeable battery 46 and circuitry 48. The motor 42 and battery 46 are fixedly mounted to the housing 18 by a mount 50, preferably secured in place by a small amount of adhesive. The circuitry 48 couples the DC motor 42 to the battery 46 and includes a switch 52 activated by the button 28 to interrupt power to the motor 42. The battery 46 includes a wire coil 54 connected to the positive terminal of the battery 46 such that when the shaver 10 is set into the cradle 14 it will act as the second winding of a transformer and receive by induction direct current from the coil in the cradle 14 (which is coupled to a power outlet by the power chord 16) through the walls of the housing 18.

This is preferred over other types of direct electric connections (such as plug and socket) because of ease of use and the ability to completely enclose the electrical components without requiring an access opening in the housing. A suitable battery 46 will provide for approximately 300 minutes 4.8 volts, which is the voltage of a preferred version of the motor 42.

Figure 6:
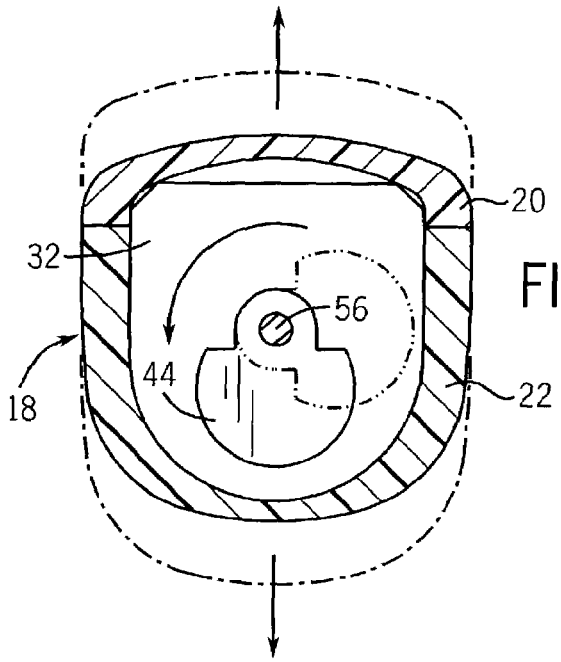
FIG. 6 is a cross-sectional view as it would appear if taken through a shoulder of the shaver along line 6—6 of FIG. 3 had the device not been exploded for illustrative purposes.

Referring now to FIG. 6, when energized, the motor 42 rotates a (preferably stainless steel) shaft 56 onto which the lobe-shaped weight 44 (preferably brass) is press-fit or otherwise connected (e.g., by a pin, spline or key arrangement). The weight 44 is eccentrically mounted to the shaft 56 so that rather than being coaxial with the shaft 56, its centerline and center of mass revolves around the shaft axis as the shaft 56 rotates. The revolving center of mass of the weight 44 effects a traveling moment action of the motor 42 which, by being fixed to the housing 18, imparts an oscillating vibratory motion to the housing 18 and the razor cartridge 12.

Figure 4:
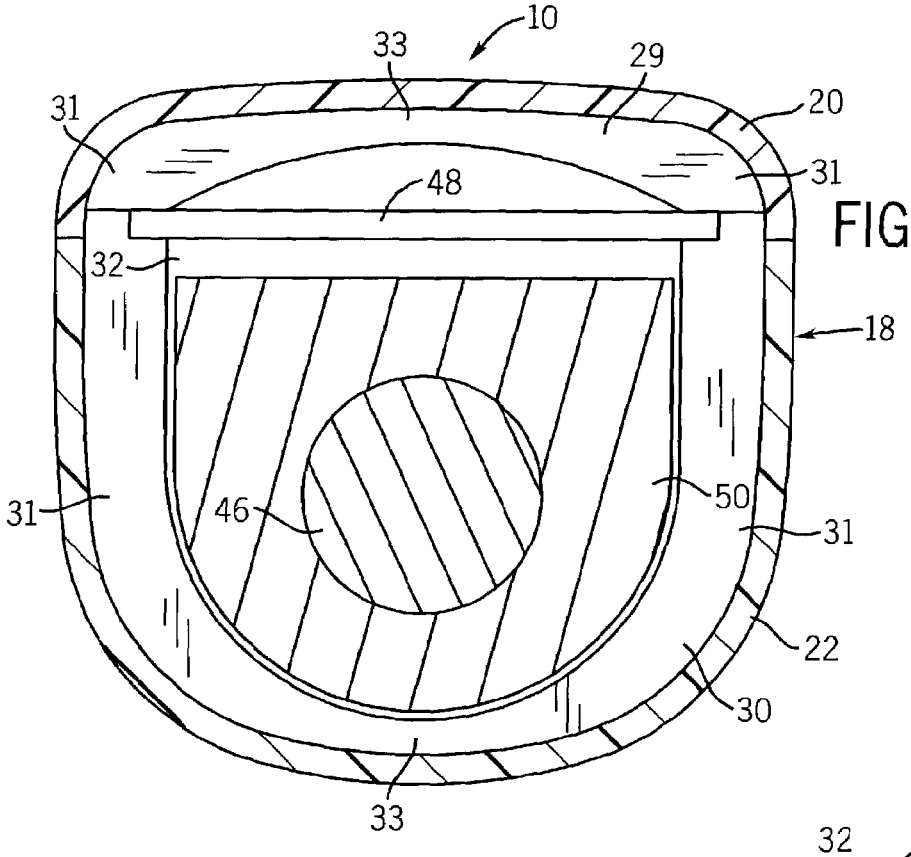
FIG. 4 is a cross-sectional view as it would appear if taken through the body of the shaver along line 4—4 of FIG. 3 had the device not been exploded for illustrative purposes.
Figure 5:
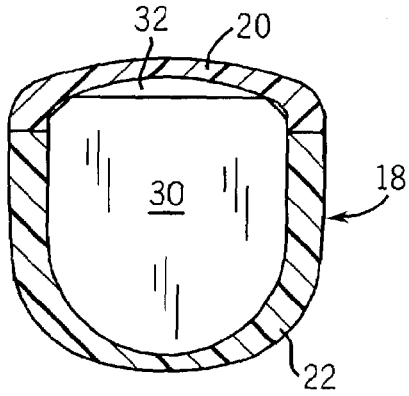
FIG. 5 is a cross-sectional view as it would appear if taken through the neck of the shaver along line 5—5 of FIG. 3 had the device not been exploded for illustrative purposes.

However, the resulting oscillatory path traveled by the razor cartridge 12 is selectively directed by the construction of the housing 18 by various techniques so that the housing resists side to side motion more than front to back motion. In particular, as mentioned above, the housing 18 has a greater side to side (width or lateral) dimension (parallel to the length of the razor blades) than the front to back (depth or transverse) dimension (perpendicular to the length of the razor blades). In addition, the wall thickness of the housing 18 is greater in the lateral dimension than the front to back dimension (at least in the neck section 36 as shown in FIG. 5) and the ribs 29 and 30 having lateral sections 31 extending into the cavity 32 further in the lateral direction than front and back sections 33 extend in the front to back dimension (as shown in FIG. 4).

The housing 18 is thus constructed to have increased material, and thus be more rigid, in the lateral dimension than in the front to back dimension to correspondingly limit motion side to side motion relative to front to back motion. The net result is primarily front to back oscillatory motion. This motion achieves a closer shave due to the razor blades being moved toward the surface of the skin at the base of the exposed hair follicle in an almost clawing motion. At the same time, side to side motion is low, reducing the risk of slicing cuts occurring along the skin rather than the hair.

The oscillatory motion of the shaver 10 is very fine, even in the front to back direction. Preferably, the amplitude of movement in each of the front to back and side to side directions is between about 0.003 and 0.02 cm, again with the amplitude of the front to back motion being greater than that of the side to side motion. In an even more preferred range, the amplitude of the front to back motion is between 0.005 and 0.02 cm with side to side motion below 0.005 cm.

Another aspect of the motion of the razor cartridge 12 is the frequency or rate of oscillation of the head and thus the razor blade. The oscillation rate may be set by the speed of the motor 42, but with respect to some materials may be affected by the rigidity of the housing 18. These parameters could be selected to achieve oscillation in the ultrasonic range. However, we have found that vibrations in that range can be uncomfortable to a user.

We have surprisingly found a much lower rate of oscillation which achieves improved shaving, yet does not cause significant discomfort. We prefer to operate at between 100 to 200 Hertz ("Hz") or cycles per second. Even more preferably, we prefer to operate between 100 to 150 Hz, and still more preferably at about 130 Hz.

Figure 7:
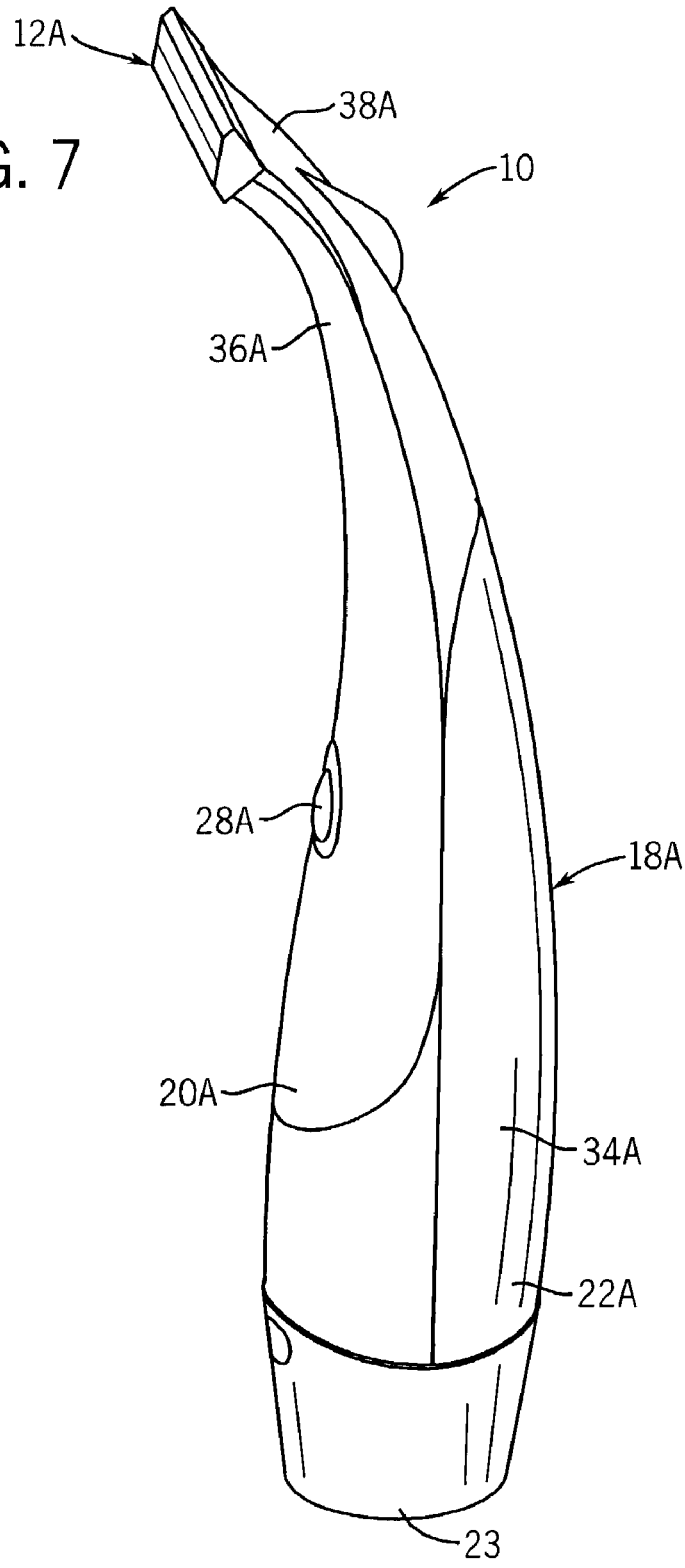
FIG. 7 is a perspective view of a second, non-rechargeable embodiment of the vibratory shaver of the present invention.
Figure 8:
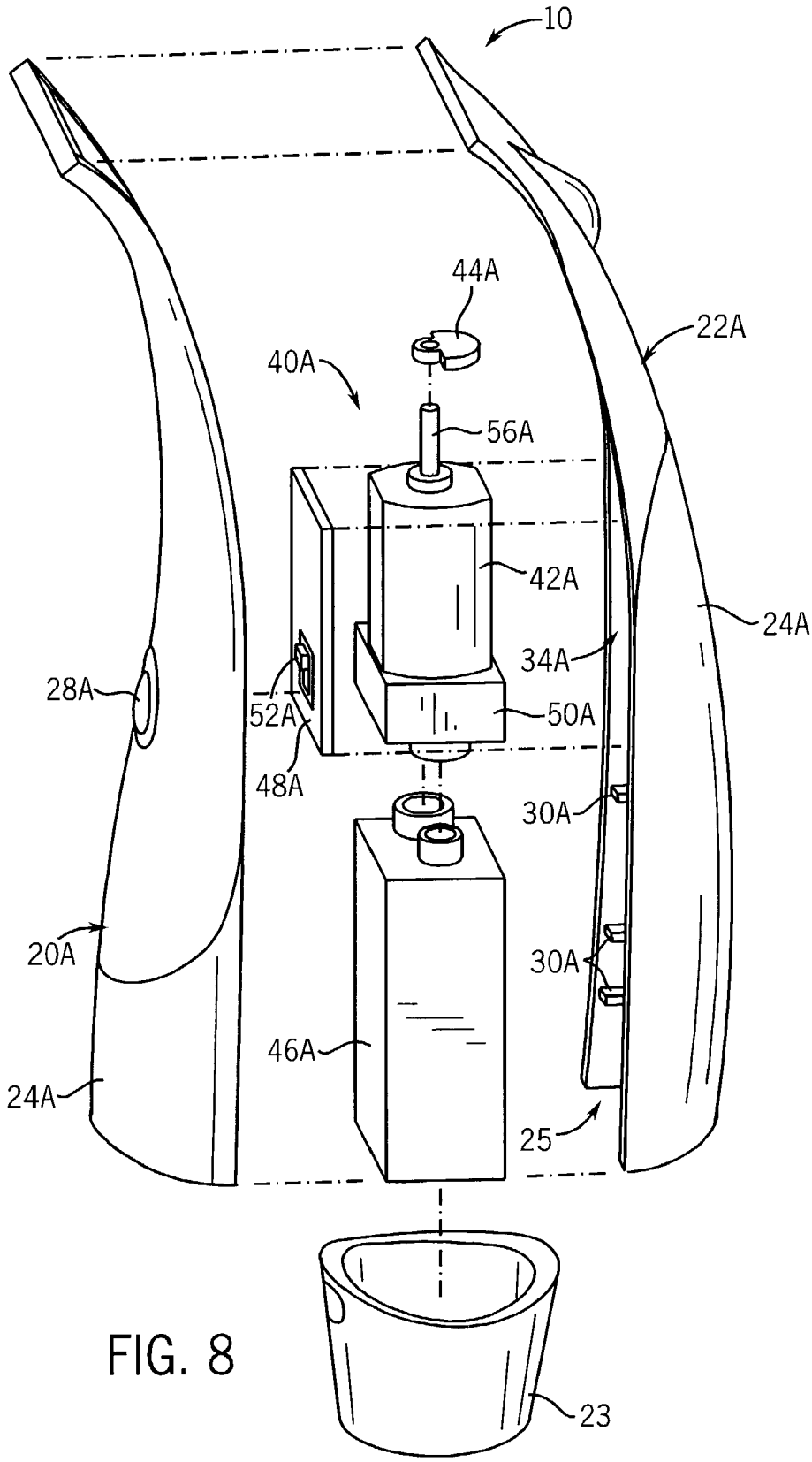
FIG. 8 is an exploded view of the shaver of FIG. 7.
Figure 9:
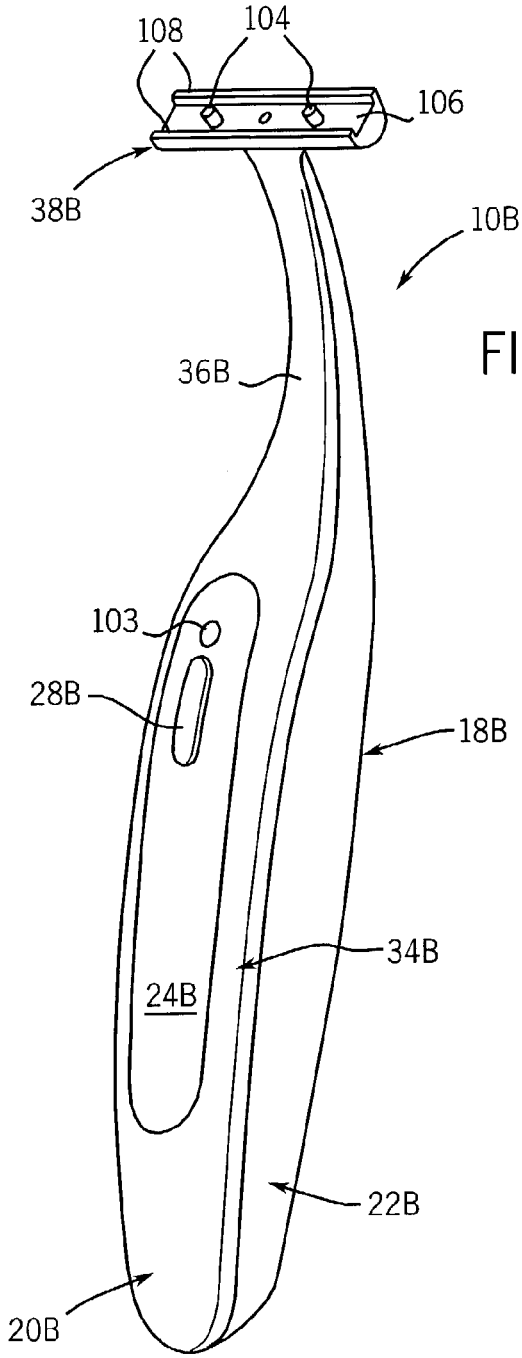
FIG. 9 is a front perspective view of a third embodiment of the vibratory shaver of the present invention shown without a razor blade attachment.

A second, non-rechargeable version of the shaver is shown in FIGS. 7 and 8. This embodiment of the shaver is essentially the same in construction and operation as the previously described embodiment, except primarily for the power source and housing configuration. Thus, many aspects of this embodiment of the invention will be described only briefly and using similar reference numerals albeit with the suffix "A".

A shaver 10A has a razor cartridge 12A mounted to its housing 18A having a main body section 34A, a narrowed neck section 36A and a broad head section 38A. As before, the razor cartridge 12A is preferably a removable, conventional disposable razor cartridge, as known in the art. The housing 18A is now three pieces, including a front cover 20A and a back part 22A and a base cap 23 that snaps or threads onto the assembled front cover 20A and back part 22A over a battery access opening 25 at the bottom end of the housing 18A. Here, both the front cover 22A and back part 22A have a tactile over molded section 24A. As before, the front cover 22A has an opening for a switch button 28A to extend. Again, the front cover 20A and back part 22A are each formed with unitary ribs (such as 30A in back part 22A) spaced apart and extending into an interior cavity 32A formed when the housing 18A is assembled. Thus, the ribs and the shape of the housing 18A work to limit the side to side (lateral) motion to produce primarily front to back vibratory motion of the razor cartridge 12A, like described above.

As shown in FIG. 8, within the body section 34A of the housing interior cavity 32A is an electrical oscillator 40A, including a weight 44A eccentrically mounted to a rotatable shaft 56A of a DC motor 42A powered by a non-rechargeable battery 46A through circuitry 48A having on/off switch 52A. The motor 42A and battery 46A are fixedly mounted to the housing 18A by a mount 50A. The battery 46A preferably provides 9 volts, reduced by the circuitry 48A to the 4.8 volts at which the motor 42A operates. The revolving center of mass of the weight 44A imparts a primarily front to back oscillating vibratory motion on the housing 18A and in turn on the razor cartridge 12A, as discussed above.

A third version of the shaver is shown in FIGS. 9–13. This embodiment of the shaver is essentially the same in construction and operation as the previously described embodiment, except primarily for the housing configuration. Thus, this embodiment of the invention will be described briefly and only the housing construction will be shown in the drawings, with reference thereto using similar reference numerals as above albeit with the suffix "B".

A shaver 10B has a two-piece housing 18B having a front cover 20B and a back part 22B defining a main body section 34B, a narrowed neck section 36B and a broad head section 38B. The power and motion inducing components are contained within the housing 18B (in the main body section 34B) and are otherwise generally the same as described above and thus will not be described here. The front cover 22B of the housing 18B is formed with a recess in the body section to hold a rubber grip 24B, which here is a separate tactile component assembled by an adhesive to the front cover 20B, rather than being an overmold, as described above. The front cover 22B and the grip 24B each have openings 100 and 102 for a switch button 28B and an indicator light 103. Like before, the front 20B cover and back part 22B are each formed with unitary ribs (such as 30B in back part 22B) spaced apart and extending into an interior cavity 32B formed when the housing 18B is assembled.

As mentioned, this embodiment of the shaver invention primarily differs from the previously described embodiments in the configuration of the neck 36B and head 38B sections of the housing 18B. In particular, the neck section 36B is more narrow and has a more pronounced arch (shown best in FIG. 12). Even more distinguishing is the fact that the front cover 20B terminates at a much more narrowed end and does not define a part of the head section 38B, which instead is formed exclusively as a unitary part of the back part 22B. The head section 38B itself also has a different configuration than previously described. Here, the head section 38B provides a platform for attaching a razor mount (not shown) defining two parallel rails onto which can be slid a razor cartridge having parallel grooves or tracks receiving the rails. The head section 38B has alignment posts 104 extending in a gutter 106 which holds the razor mount between lengthwise walls 108. A small screw can be used to secure the rail to the head section 38B. The razor cartridge is again preferably a removable, conventional disposable razor cartridge, as known in the art.

Figure 13:
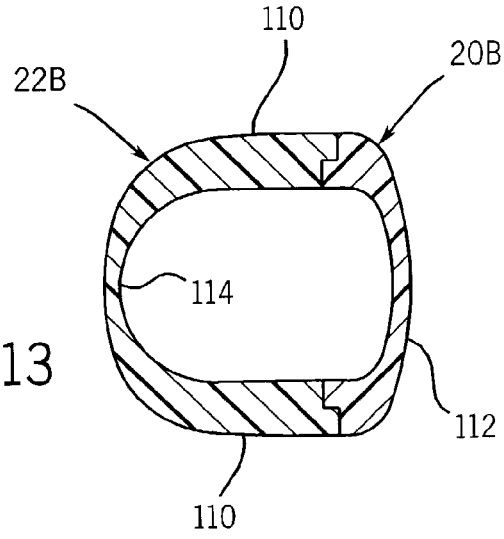
FIG. 13 is a cross-sectional view taken along line 13—13 of FIG. 12 through a neck of the housing.
Figure 10:
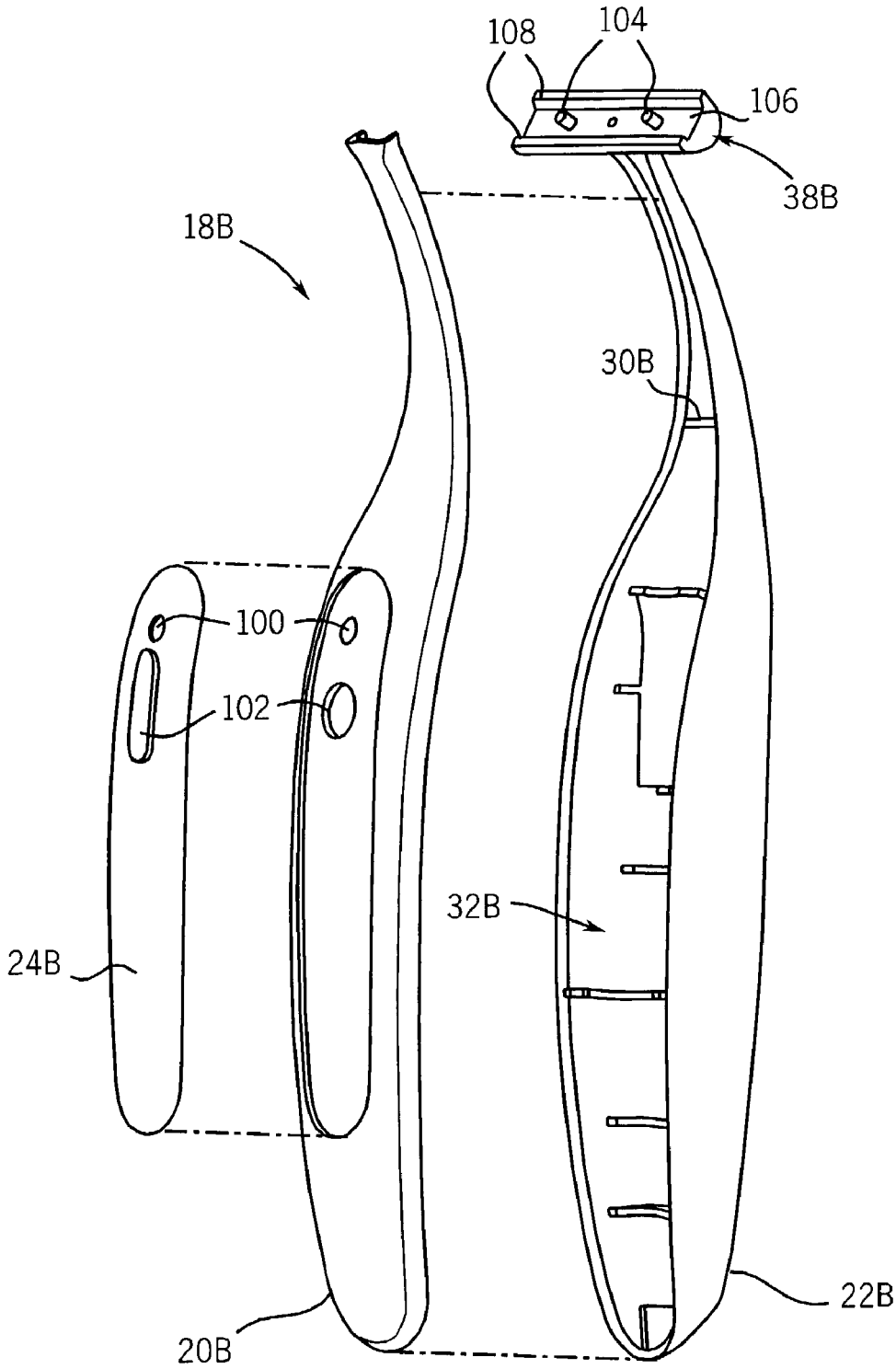
FIG. 10 is an exploded perspective view of the housing therefor.
Figure 11:
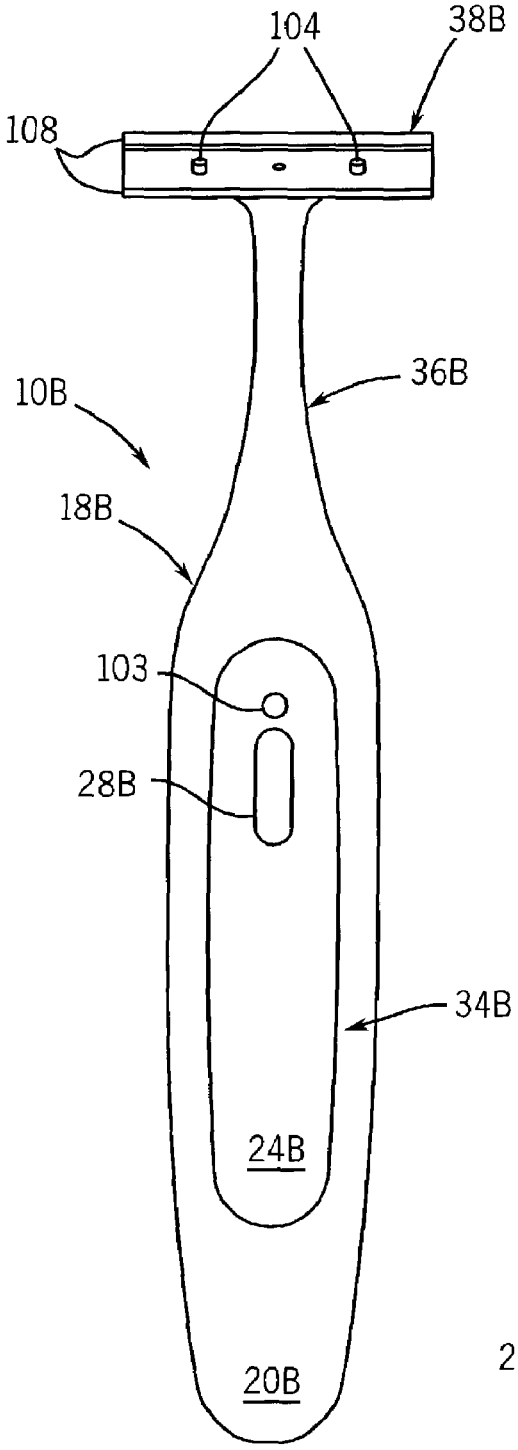
FIG. 11 is a front view of the shaver of FIG. 9.
Figure 12:
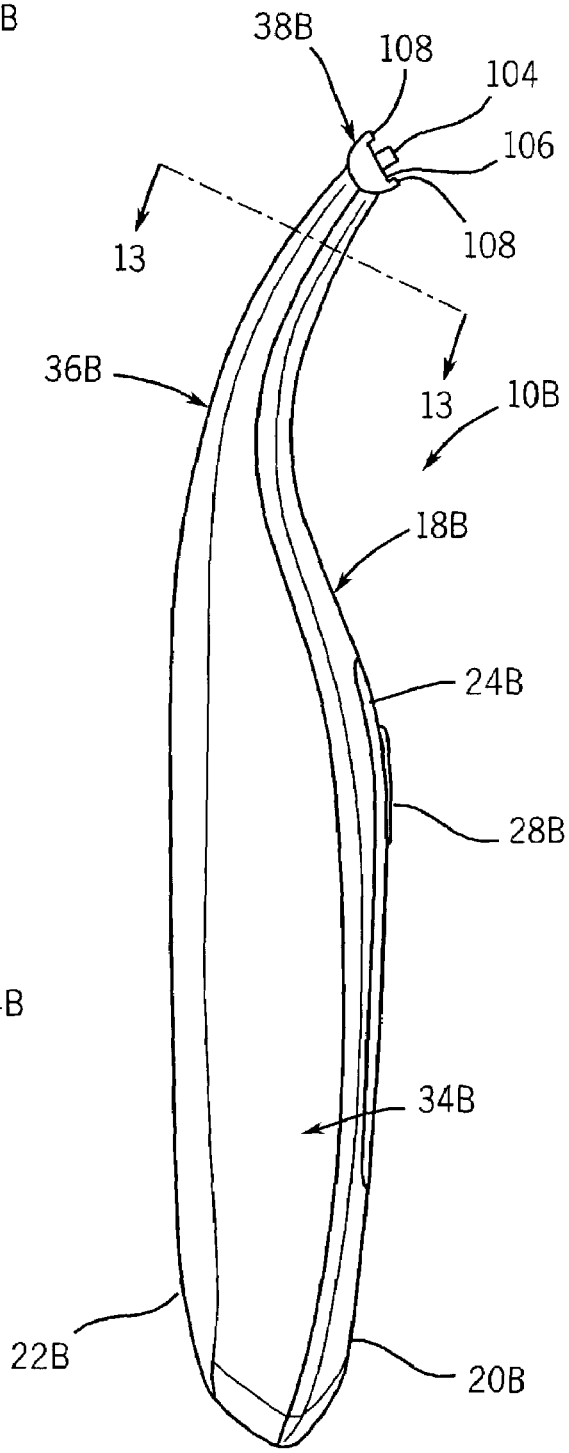
FIG. 12 is a left side view thereof.

As before, the neck section 36B is preferably hollow (except for a rib 30B), however, it could be solid since there is no direct physical connection between the motor and the razor. As shown in FIG. 13, preferably the neck section 36B has thicker side walls 110 than its front 112 and back 114 walls (although this may not be necessary). The thicker side walls, along with the presence of the ribs and the shape of the housing 188B, particularly the narrow, arched neck, work to limit the side to side (lateral) motion to produce primarily front to back vibratory motion of the razor cartridge, like described above.

Accordingly, the present invention provides electric shavers capable of using conventional disposable razor cartridges for wet or dry shaving. A low cost and reliable oscillator vibrates the housing to impart a short, rapid oscillatory motion to the razor cartridge. The dimensional attributes of the housing limit the side to side movement of the razor cartridge such that the net motion is predominately (has a maximum greater amplitude) front to back. The shaver thus provides a rapid and close shave.

It should be appreciated that preferred embodiments of the invention have been described above. However, many modifications and variations to these preferred embodiments will be apparent to those skilled in the art, which will be within the spirit and scope of the invention. For example, the preferred embodiments of the invention are shown and described having a hollow housing, particularly at the neck section 36. Since no physical connection is required between the revolving weight 44 and the razor cartridge 12, however, it is well within the scope of the invention for the neck section (or parts thereof) 36 to be formed solid, provided it retains sufficient flexibility to achieve the desired motion. The same is true from the head section 38 and parts of the body 34 as well. Therefore, the invention should not be limited to the described embodiments. To ascertain the full scope of the invention, the following claims should be referenced.

INDUSTRIAL APPLICABILITY

The invention is a vibratory shaving implement providing primarily back motion of the razor head for a closer shave.

What is claimed is:

1. A vibratory shaver comprising:

a. an outer housing having an elongated body defining front, back and opposite side walls of the body, said side walls of the body connecting side front and back walls of the body, a neck extending essentially axially from the body, and a head attached to the neck at a location remote from the body, said head having a side to side length and a front to back width with said side to side length being elongated relative to said front to back width, the body and neck being formed as an essentially rigid, continuous and non-jointed structure that resists side to side motion along said length of said head to a greater degree than from to back motion.

b. a battery positioned in the body;

c. a motor capable of being energized by the battery and also being positioned in the body; and d. a weight positioned in the housing and mounted to the motor so as to be rotated thereby to vibrate the housing;

wherein the neck is hollow and has side walls and front and back walls, and there is internal bracing extending from one of said neck side walls to the other of said neck side walls, that internal bracing of the neck extending from adjacent an interior surface of said back wall of the neck towards said front wall of the neck; wherein at a given location along the neck, the thickness of the neck side walls exceeds the thickness of the neck front and neck back walls; and that internal bracing of the neck extending from adjacent an interior surface of said back wall of the neck towards said front wall of the neck;

wherein at a given location along the neck, the thickness of the neck side walls exceeds the thickness of the neck front and neck back walls; and whereby rotation of the weight causes the head of the shaver to oscillate with a greater front to back amplitude than a side to side amplitude, and side to side flexing of the neck is suppressed, compared to front to back flexing, by the bracing.

2. The shaver of claim 1, wherein the neck has a maximum side to side dimension greater than its maximum front to back dimension.

3. The shaver of claim 2, wherein the neck is forwardly arched from the body to the head.

4. The shaver of claim 1, wherein the neck is forwardly arched from the body to the head.

5. The shaver of claim 1, wherein the body has a maximum lateral dimension which is greater than its maximum front to back dimension.

6. The shaver of claim 1, further comprising a razor cartridge having a blade and the head includes an attachment feature for removably connecting the razor cartridge to the head.

7. The shaver of claim 6, wherein the attachment feature is a rail and the razor cartridge is formed with a slot for receiving the rail.

8. The shaver of claim 1, wherein the battery is rechargeable.

9. The shaver of claim 8, further comprising a recharging cradle having a receiving cavity suitable for receiving a lower end of the housing.

10. The shaver of claim 9, wherein the cradle is capable of recharging the battery via induction.

11. The shaver of claim 1, further comprising a switch for controlling operation of the motor, the switch being controllable from outside the housing.

12. The shaver of claim 1, wherein the motor has an axial shaft and the weight is mounted to the motor shaft eccentrically.

13. The shaver of claim 1, wherein the shaver is designed so that the housing oscillates only within a range of 100 to 200 cycles per second when the housing oscillates in response to movement of the weight.

14. The shaver of claim 13, wherein the shaver is designed so that the housing oscillates at no more than about 150 cycles per second when the housing oscillates in response to movement of the weight.

15. The shaver of claim 1, wherein the maximum lateral oscillation movement of the head caused by the movement of the weight is less than 0.02 cm, while the head will have a front to back maximum lateral movement that is greater than that in response to movement of the weight.

16. The shaver of claim 1, wherein the body also has internal bracing, and wherein the internal bracing of the body has a greater dimension in a lateral side to side direction than in a front to back direction.

17. The shaver of claim 16, wherein the internal bracing of the body extends between a body side wall and an opposite side wall of the body.

18. The shaver of claim 3, wherein the neck curves from the back-most surface of the body forwardly to the head.

19. The shaver of claim 1, wherein the neck has a maximum circumference that is less than a maximum circumference of the body.

20. The shaver of claim 1, further comprising a removable lower cap suitable for facilitating access to the battery.

* * * * *